US007893952B2

(12) United States Patent
Bandholz et al.

(10) Patent No.: US 7,893,952 B2
(45) Date of Patent: Feb. 22, 2011

(54) PRINT HEAD WITH UNIFORM LOADING

(75) Inventors: Brent A. Bandholz, Hubertus, WI (US); Robert J. Godfrey, Baraboo, WI (US); Robert L. Schanke, New Berlin, WI (US)

(73) Assignee: Brady Worldwide, Inc., Milwaukee, WI (US)

( * ) Notice: Subject to any disclaimer, the term of this patent is extended or adjusted under 35 U.S.C. 154(b) by 141 days.

(21) Appl. No.: 12/482,806

(22) Filed: Jun. 11, 2009

(65) Prior Publication Data

US 2009/0309947 A1 Dec. 17, 2009

Related U.S. Application Data

(60) Provisional application No. 61/061,456, filed on Jun. 13, 2008.

(51) Int. Cl.
*B41J 25/304* (2006.01)

(52) U.S. Cl. ..... 347/197; 400/120.16

(58) Field of Classification Search ..... 347/197, 347/198; 400/120.16, 120.17
See application file for complete search history.

(56) References Cited

U.S. PATENT DOCUMENTS

| | | | | |
|---|---|---|---|---|
| 4,000,393 | A | 12/1976 | Cochran et al. | |
| 4,560,292 | A | 12/1985 | Takahashi | |
| 4,563,690 | A | 1/1986 | Tomita et al. | |
| 4,710,040 | A | 12/1987 | Grey | |
| 4,750,880 | A | 6/1988 | Stephenson et al. | |
| 4,844,632 | A * | 7/1989 | Minowa | 400/120.17 |
| 5,014,073 | A * | 5/1991 | Sone et al. | 347/198 |
| 5,206,662 | A | 4/1993 | Fox et al. | |
| 5,411,339 | A | 5/1995 | Bahrabadi et al. | |
| 5,517,915 | A | 5/1996 | Oshino et al. | |
| 5,541,635 | A | 7/1996 | Wills et al. | |
| 5,746,520 | A | 5/1998 | Kohira | |
| 6,353,453 | B1 | 3/2002 | Lien et al. | |
| 6,398,434 | B1 | 6/2002 | Corrigan, Jr. | |
| 6,480,216 | B2 | 11/2002 | Ando | |
| 6,672,780 | B2 | 1/2004 | Yehl et al. | |
| RE38,473 | E | 3/2004 | Smolenski | |
| 6,977,668 | B2 * | 12/2005 | Sautter | 347/197 |
| 2003/0184640 | A1 | 10/2003 | Sasaki | |

FOREIGN PATENT DOCUMENTS

| | | | |
|---|---|---|---|
| EP | 0213934 | A2 | 3/1987 |
| EP | 0371718 | A2 | 6/1990 |
| EP | 0806297 | A2 | 11/1997 |
| EP | 1516737 | A1 | 3/2005 |
| JP | 2004098699 | | 4/2004 |

OTHER PUBLICATIONS

PCT International Search Report for PCT/US2009/047068 mailed Jan. 29, 2010 (2 pages).

* cited by examiner

*Primary Examiner*—Huan H Tran
(74) *Attorney, Agent, or Firm*—Quarles & Brady LLP

(57) ABSTRACT

An improved print head assembly is disclosed that provides even pressure over the width of a print face across a platen roller. Accordingly, the print head assembly can perform edge-justified printing operations without portions of the print being faint or skewing due to uneven pressure across the print head.

15 Claims, 12 Drawing Sheets

PRINT HEAD WITH UNIFORM LOADING

CROSS-REFERENCE TO RELATED APPLICATION

This application claims the benefit of U.S. Provisional Patent Application No. 61/061,456 filed Jun. 13, 2008, the disclosure of which is hereby incorporated by reference in entirety.

STATEMENT OF FEDERALLY SPONSORED RESEARCH OR DEVELOPMENT

Not applicable.

BACKGROUND OF THE INVENTION

This invention relates to printers. In particular, this invention relates to thermal transfer printers for the printing of labels.

In thermal transfer printing, a layer of print material, such as ink, is heated to be selectively applied to the print media (e.g., a label). Commonly, the ink is carried on a ribbon which, along with the label, is fed between a thermal print head and a platen roller. As the ribbon passes the thermal print head, the thermal print head melts the ink from the ribbon for transfer onto the label. Ideally, the thermal print head applies sufficient nip pressure against the platen roller to effectively transfer the ink from the ribbon onto the label. Additionally, the nip pressure between the thermal print head and the platen roller may help to maintain tension on the ribbon as it is fed past the print head.

In thermal transfer printing, the print quality depends on the evenness with which the print head applies pressure across the ribbon and the label. For example, if uneven pressure is applied by the print head across the ribbon, then some portions of the ribbon may heat quickly while other portions of the ribbon may heat slowly. On the portions of the ribbon that heat more slowly, the ink may not fully melt for transfer to the print media. Likewise, if the pressure applied across the ribbon and the label is uneven, then there may be portions of the interface between the ribbon and the label that are not pressed together. If there is poor contact between the ribbon and the print media, then the ink may not transfer from the ribbon to the label, resulting in poor print quality.

Further, it is often desirable that a printer be capable of printing on various widths of print media such that a single printer is capable of printing on a variety of print media. However, in thermal transfer printers, the accommodation of the various sizes of print media poses serious challenges, particularly when coupled with the aforementioned requirement of applying even pressure across the print head. In particular, when the print media is narrower than the width of the print head, a decision needs be made about the manner in which the print media will be justified in the printer.

To avoid some of the problems associated with uneven pressure across the print head, the print media could be center justified. However, center justification typically requires that there be two moveable edge guides.

Moveable edge guides (1) complicate the assembly of the printer and (2) require action by the user to make proper edge guide adjustments for each print job. Moreover, center justification can cause problems with the placement of label registration sensors within the printer that target the location of the print on the print media.

To avoid some of the problems associated with moveable edge guides and sensor placement, the print media may be edge justified to one side of the print head. Although edge justification of the media on the platen roller alleviates some of the problems with guiding and sensing, uneven print head pressure becomes a larger problem, particularly when printing onto print media that is less than half the width of the print head through the printer. As a result, the print on or near the outer edge of the print media may be light. Typically, an adjustment to a printing load mechanism is required to redistribute the pressure of the print head uniformly across the print media. However, this pressure skew adjustment is undesirable as it makes the printer more difficult or confusing to operate for the end-user. Alternate solutions to having the user make the pressure skew adjustment are possible, but are expensive to implement (i.e., the addition of sensors and pressure adjusting mechanisms).

Hence, there is a need for an improved print head that uniformly applies pressure across the platen roller, regardless of the justification of the print media. Moreover, there is a need for improving the print quality of thermal printers, particularly in edge-justified printing operations.

SUMMARY OF THE INVENTION

A print head assembly is provided for a printer which provides uniform pressure over a print face. The print head assembly includes a frame, a platen roller, a print head, and at least one biasing member. The frame has a pair of opposite-facing side walls. The platen roller is rotatably mounted between the side walls of the frame about an axis of rotation. The print head has a print face extending between ends of the print head and is pivotally movable relative to the frame about a pivot axis parallel to the axis of rotation of the platen roller. At least one biasing member is located between the frame and the print head. The biasing member or members urge the print head towards the pivot axis with a first force and also urge the print face towards the platen roller with a second force. The first force is greater than the second force such that the first force maintains the pivot axis of the print head and the second force applies a uniform pressure over a width of the print face.

The frame may include an upper print frame and a lower print frame. The upper print frame may include a bracket that is rigidly connected to the upper print frame and that is movably coupled to the print head. In one form, the bracket may be moveably coupled to the print head via a tab that extends horizontally from the front of the bracket towards the back of the bracket to prevent the print head from rotating away from the bracket. In another form, the bracket may be moveably coupled to the print head via a post on one of the print head and the bracket that extends through a hole on the other of the print head and the bracket. The post may have a retaining cap that prevents the print head and the bracket from separating.

A pivot, such as a hinge, may rotatably connect the upper print frame to the lower print frame and a latch opposite the pivot may retain the upper print frame to the lower print frame. Thereby, the print face is kept against the platen roller and a locating pivot shaft of the print head is retained in the locating slot of the lower print frame.

The print head may be a thermal print head and at least a portion of the print head may be a heat sink. The thermal print head may be used to print labels.

There may be a plurality of biasing members including at least one biasing member proximal each end of the print head to urge the print head towards the pivot axis with the first force and at least one biasing member proximal the print face to urge the print face towards the platen roller with the second force. The biasing member or members proximate the pair of ends of the print head may be configured to provide a greater biasing force than the biasing member or members proximate the print face. In this way, the pivot axis of the print head is maintained and the print head does not skew during an edge-justified printing operation. The biasing member or members may be springs. If there are a plurality of biasing members, then they may be symmetrical about a plane extending though the print head in the direction of printing.

According to another form, the print head assembly includes an upper print frame, a lower print frame, a print head, and a plurality of biasing members. The lower print frame has a pair of opposite-facing side walls with a platen roller extending therebetween. The side walls also have a pair of locating slots formed therein. The print head is movably coupled to the upper print frame and has an upper face facing the upper print frame. The print head has a locating pivot shaft proximate one end of the print head and a print face proximate an other end of the print head. The plurality of biasing members are located between the upper print frame and the upper face of the print head. These include at least a first biasing member proximate the locating pivot shaft and at least a second biasing member proximate the print face. Each of the first biasing member or members proximate the locating pivoting shaft are further from a centerline of the print head along a direction of printing than the second biasing member or members proximate the printing face. When the upper print frame and the lower print frame are coupled together, the first biasing member or members proximate the locating pivot shaft urge the locating pivot shaft into the pair of locating slots such that the print head assembly can pivot about the locating pivot shaft while the second biasing member or members proximate the print face provide uniform pressure across the print face over the length of the platen roller.

There may be two or more of each of the first and second biasing members.

Thus, the present invention provides an improved print head assembly having even pressure over the width of the print face across the platen roller. Accordingly, the print head assembly can perform edge-justified printing operations without portions of the print being faint or skewed.

These and still other advantages of the invention will be apparent from the detailed description and drawings. What follows is merely a description of a preferred embodiment of the present invention. To assess the full scope of the invention the claims should be looked to as the preferred embodiment is not intended to be the only embodiment within the scope of the claims.

DETAILED DESCRIPTION OF THE PREFERRED EMBODIMENT

Figure 1:
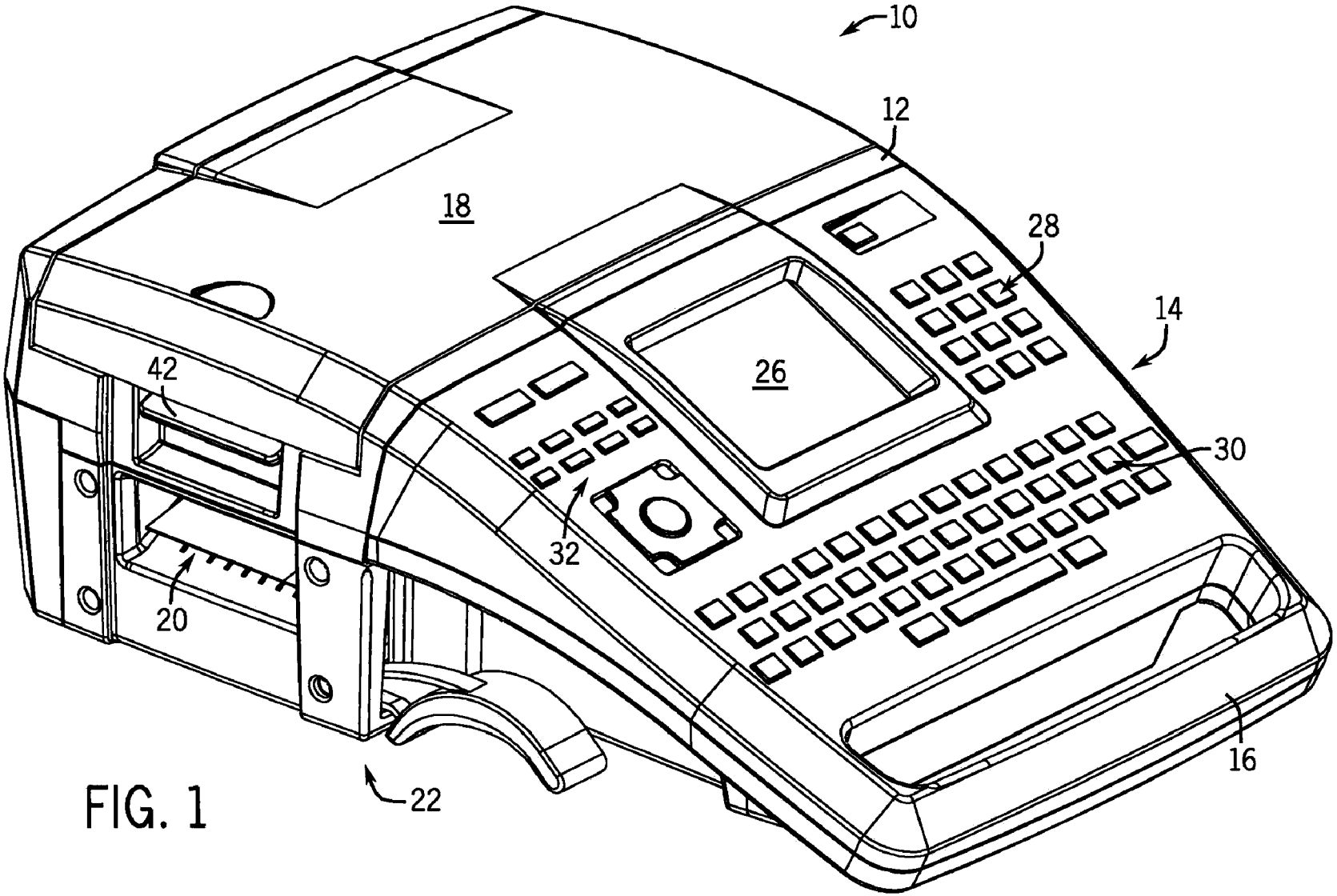
FIG. 1 is a front side perspective view of a printer.

Referring now to FIG. 1, a printer 10 for the printing of labels is shown. The printer 10 has a body 12 including a user interface 14, a handle 16 for easy transport of the printer 10, a moveable cover 18 for accessing a print assembly transversely mounted within the body 12 of the printer 10, a print slot 20 that dispenses the printed labels out of the printer 10, and a cutting assembly 22 for the cutting or separation of printed labels. It should be appreciated that the printer 10 may be operable when oriented in directions other than that shown in FIG. 1. For example, the printer 10 may be placed on its side or with the handle 16 directed up.

The user interface 14 allows the user to input data for printing on a label and commands for controlling the printer 10. The user interface 14 may include, but is not limited to, a display 26 for the display of entered data or prompting of user input, a keypad 28 and a keyboard 30 for entering data, and function buttons 32 that may be configured to perform various functions typical to printing (i.e., power on/off, forward feed, stop printing, and the like) or can be programmable for the execution of user-defined macros.

The user interface 14 may be supplemented by or replaced by other forms of data entry or printer control. For example, a separate data entry and control module may be linked wirelessly or by a data cable to the printer 10. The data entry and control module can include a computer, a router, and the like, without departing from the scope of the invention.

Figure 2:
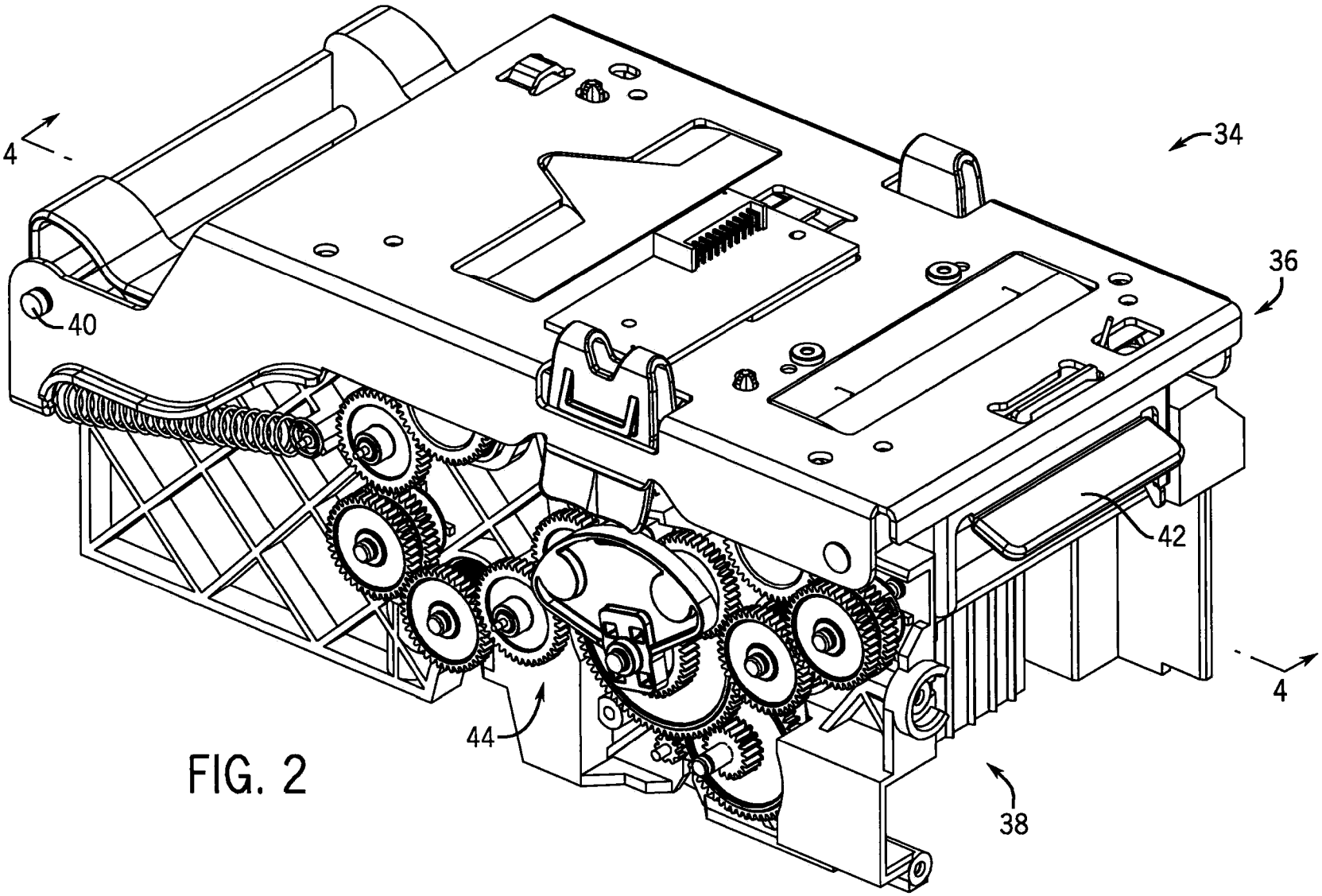
FIG. 2 is a perspective view of a print assembly contained within the printer of FIG. 1 with the print assembly in a closed position.

Referring now to FIG. 2, a print assembly 34 is shown after having been removed from the inside of the printer 10. The print assembly 34 is mounted transversely in the printer body and includes an upper print frame 36 and a lower print frame 38. On the rear side of the print assembly 34, the upper print frame 36 and the lower print frame 38 are pivotally connected at a hinge 40. On the front side of the print assembly 34, a latch 42 releasably secures the upper print frame 36 and the lower print frame 38 together.

The print assembly 34 can be in an opened or a closed position. In the view shown in FIG. 2, the print assembly 34 is in the closed position. In this view, the upper print frame 36 and the lower print frame 38 are held together by the hinge 40 on one side and the latch 42 on the other side. In the view shown in FIG. 3, the print assembly is in the opened position. In this position, the latch 42 is released such that the upper print frame 36 and the lower print frame 38 can be moved apart from one another to provide easy access to the internal components of the print assembly 34. It should be noted that while a hinged assembly has been described, that other structures for holding an upper print frame to a lower print frame are contemplated.

In some forms, the upper print frame 36 may be secured to the moveable cover 18 and the latch 42 may be accessible from the exterior of the printer 10. In this way, when the latch 42 is released to allow the upper print frame 36 to pivot relative to the lower print frame 38, the upper print frame 36 and the moveable cover 18 move together so as to minimize the steps necessary to open the printer 10 and access the interior for the replacement of consumables or other maintenance operations.

Figure 3:
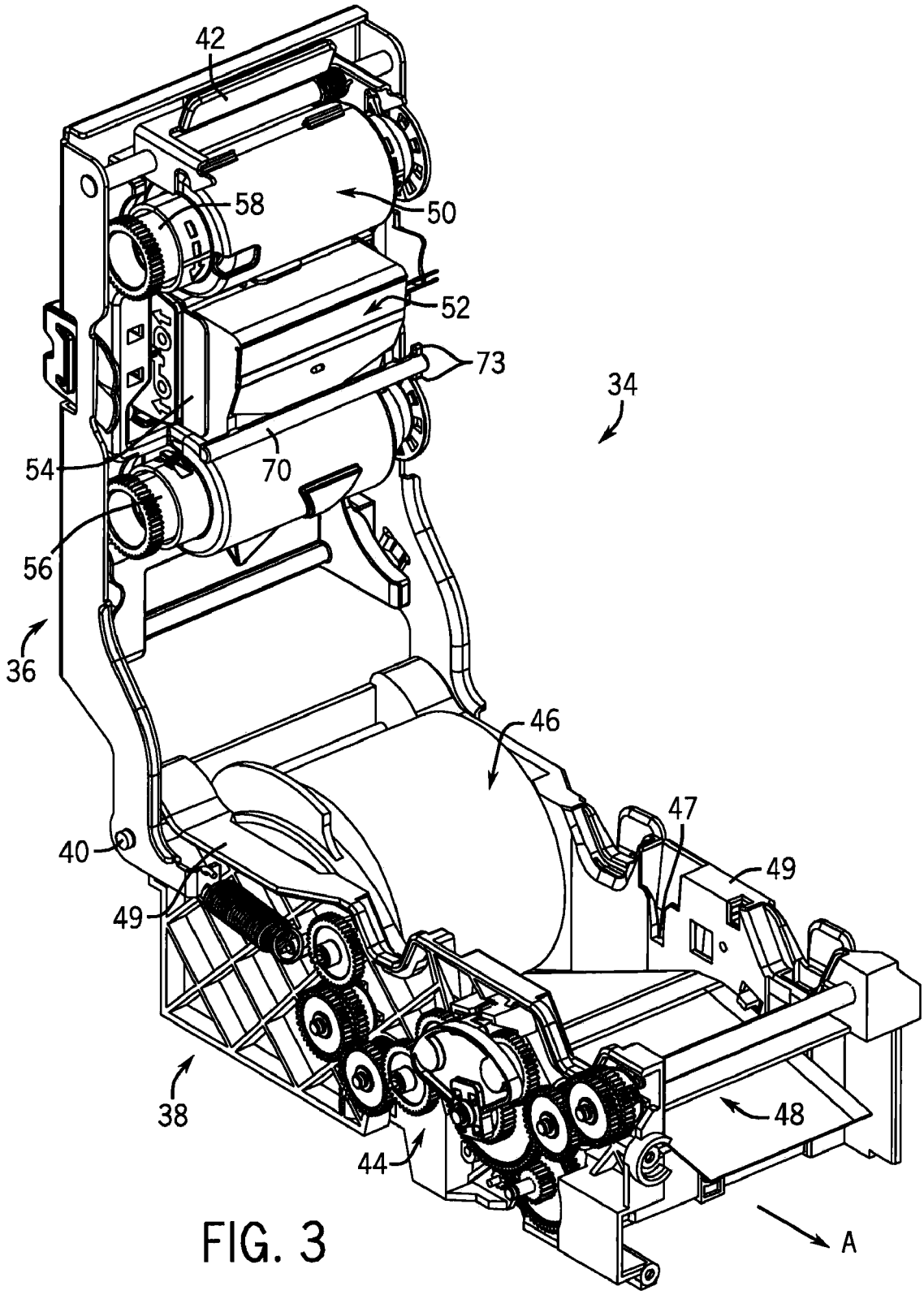
FIG. 3 is a perspective view of the print assembly of FIG. 2 in an opened position.

Referring now to FIG. 3, the print assembly 34 is shown after the latch 42 has been released to allow the upper print frame 36 to pivot away from the lower print frame 38, thus moving the print assembly 34 into the opened position and exposing the interior of the print assembly 34. On the inside of the print assembly 34, a roll assembly 46 has been loaded into the lower print frame 38. The roll assembly 46 carries a print media, such as, for example, labels, thereupon.

In the opened position, the internal components attached to the upper print frame 36 can also be seen. Attached to the upper print frame 36 are a bracket 54 having a print head 52 moveably coupled thereto and a ribbon cartridge 50. The ribbon cartridge 50 includes a supply spool 56 and a take-up spool 58 that can have a ribbon (not shown), such as an ink ribbon, extending therebetween. The ribbon cartridge 50 may be selectively driven by the gear train 44 or another motive element to feed the ribbon between the two spools 56, 58.

The print head 52 is located between the two spools 56, 58 such that the ribbon passes across the print head 52 for a printing process, such as, for example, thermal transfer printing in which the ink on the ribbon is selectively melted to the print media. If the print head is a thermal transfer print head, then the print head 52 may include heating elements allowing for the selective heating of the print head 52, associated control circuitry, a heat sink for the dissipation of the heat from the print head 52, and the like.

Figure 4:
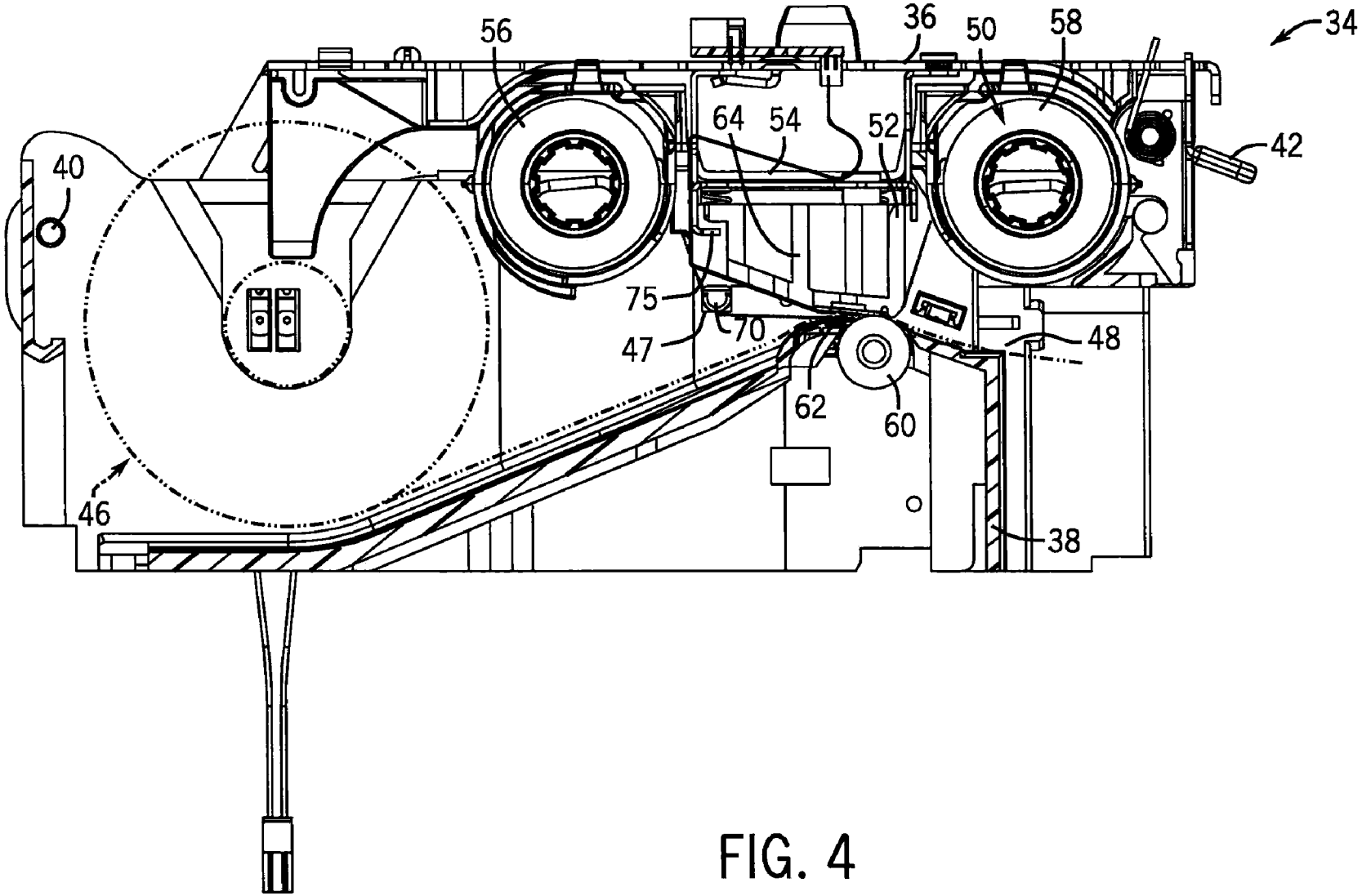
FIG. 4 is a cross-sectional view along line 4-4 of FIG. 2.

Referring now to FIG. 4, a cross-sectional view of the print assembly 34 is shown with the print assembly 34 in the closed position and the print media fed through the print assembly 34 in phantom lines. As can be seen in this view and with additional reference to FIGS. 9-12, when the print assembly 34 is closed, the print head 52 is biased away from the bracket 54 by biasing members 78*a*, 78*b*, 78*c*, 78*d* to apply pressure across a platen roller 60 located in the lower print frame 38. When the print media on the roll assembly 46 and the ribbon are fed between the print head 52 and the platen roller 60 by the rotation of the platen roller 60, the print head 52 applies a pressure across the ribbon and print media and can be selectively heated to transfer the ink on the ribbon to the print media. After the media has been printed on, the media is fed out a slot 48 located on the side of the print assembly 34.

The gear train 44, mounted on the side of the lower print frame 38 and driven by a motor (not shown), drives the printing operation. Specifically, the gear train 44 drives the rotation of the platen roller 60 for feeding the media and the spools 56, 58 of the ribbon cartridge 50 for feeding the ribbon.

Due to the consumable nature of the printing process, many of the components in or attached to the print assembly 34 may be replaceable. For example, as the roll assembly 46 and the ribbon cartridge 50 are consumed during the printing process, it may be necessary to replace them from time to time. Thus, it may be beneficial to have easy access to the internal components of the print assembly 34.

Figure 5:
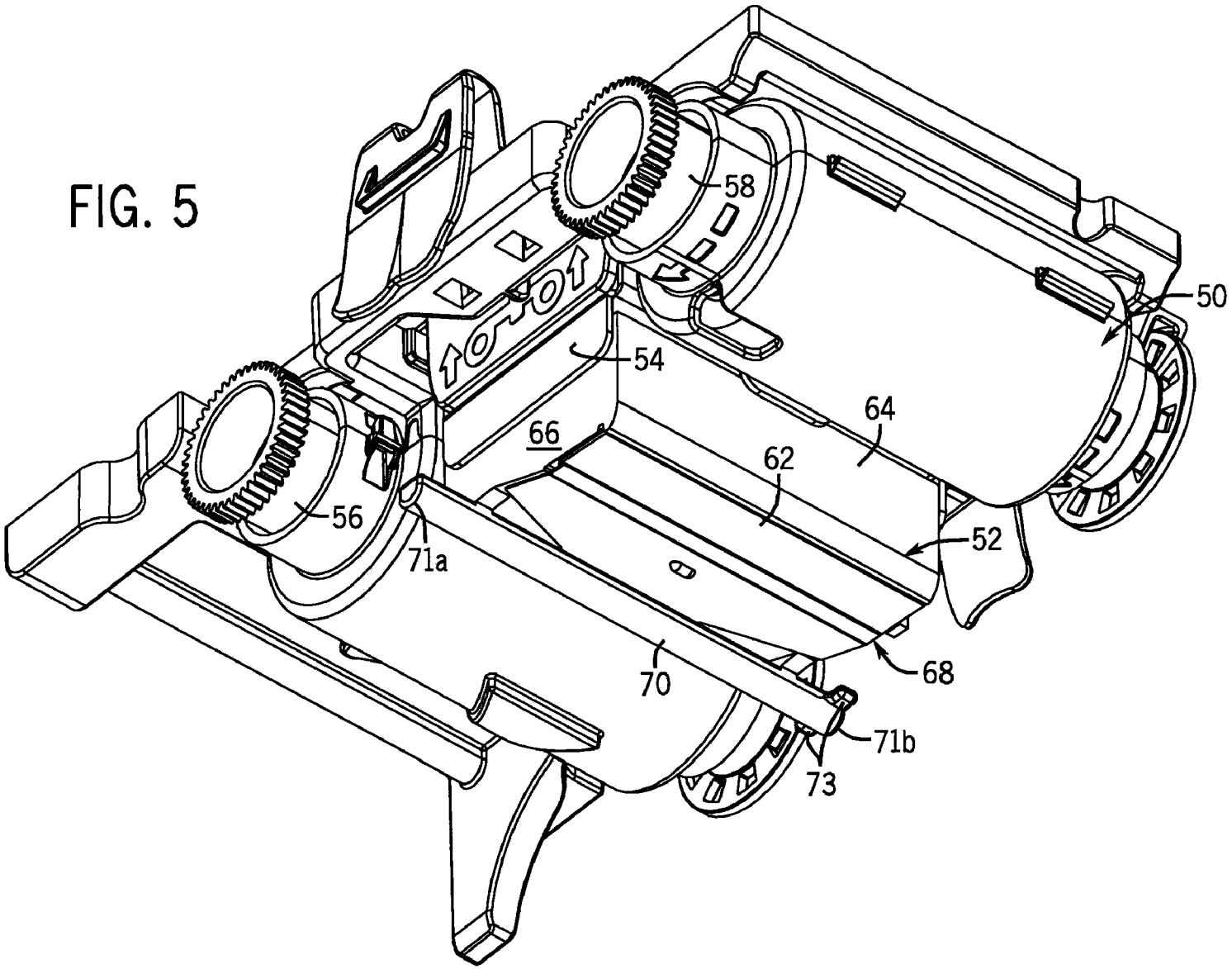
FIG. 5 is a bottom perspective view of the upper print frame including the print head.
Figure 6:
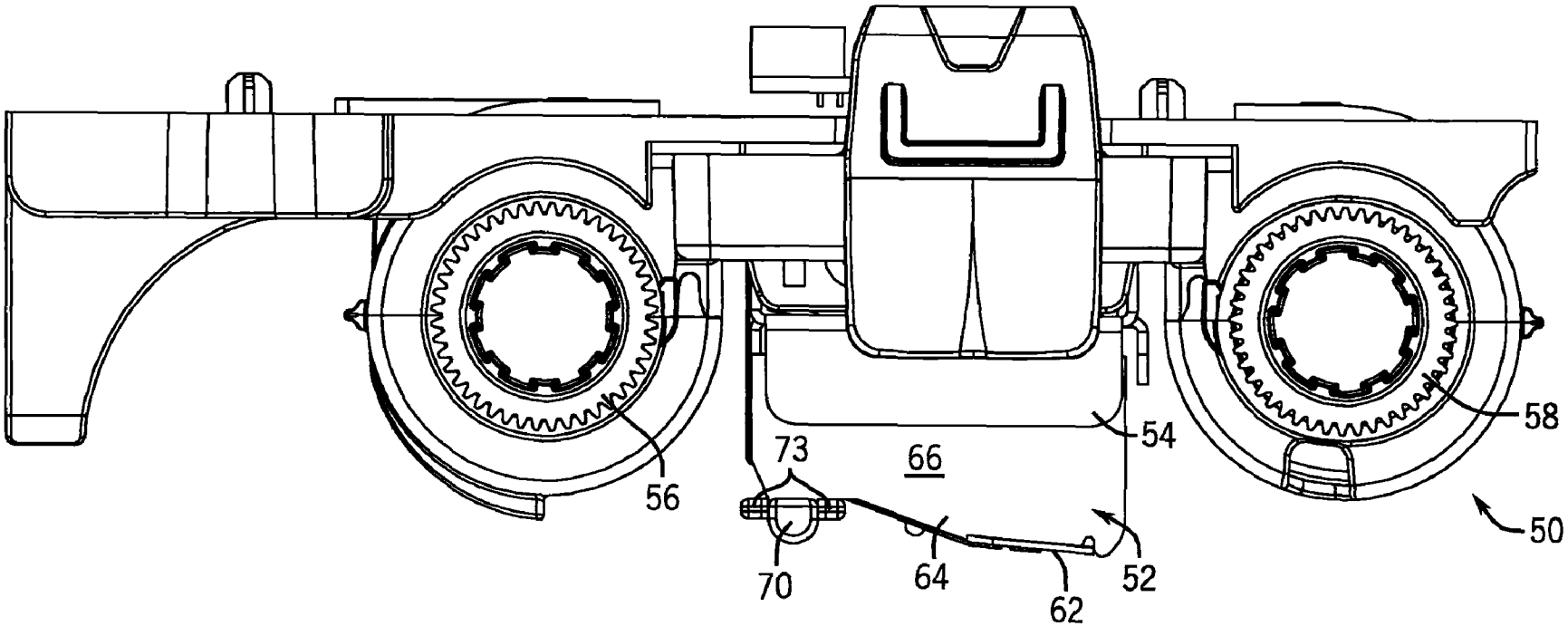
FIG. 6 is a left side view of the upper print frame including the print head.

Referring now to FIGS. 5 and 6, the structural details of the upper printing components are shown. In this view, the ribbon cartridge 50, the print head 52, and the bracket 54 are shown with a portion of the upper print frame 36. From this angle, a print face 62 on the bottom of the print head 52 is visible. The print face 62 extends between a pair of ends 66, 68 of a heat sink 64 which comprises the bulk of the body of the print head 52. The print face 62 is the portion of the print head 52 that selectively heats to ribbon during the printing operation.

The print face 62 may be attached to the heat sink 64 via an adhesive. This adhesive is preferably stable at printing temperatures (i.e., the temperature of printing will not degrade the adhesive qualities of the adhesive). Likewise, it is desirable that the adhesive has a high thermal conductivity, such that it can efficiently and quickly transfer heat from the print face 62 into the heat sink 64 during printing.

Figure 12:
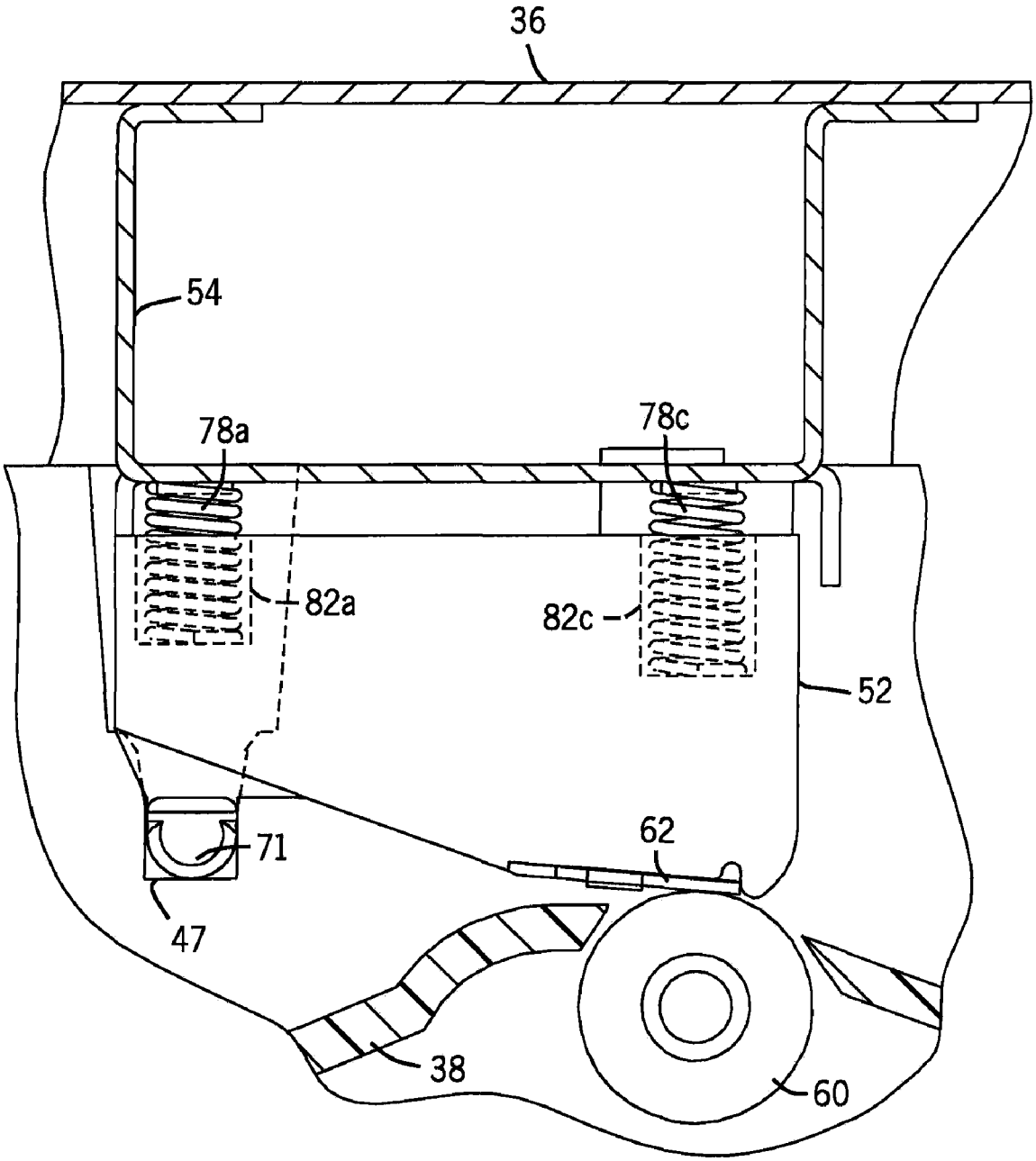
FIG. 12 is a side plan view of FIG. 8, with the locating shaft positioned in the locating slot of the lower print frame.

The print head 52 also includes a locating shaft 70 that is used to define an axis of rotation of the print head 52 relative to the lower print frame 38. The locating shaft 70 extends from the left side of the print head 52 to the right side of the print head 52. When the print assembly 34 is closed, the ends 71*a*, 71*b* of the locating shaft 70 are received in the pair of locating slots 47 (as are best seen in FIG. 12) in the lower print frame 38. The locating slots 47 are positioned such that the print head 52 is pivotally movable in the lower print frame 38 about a pivot axis that is parallel to the axis of rotation of the platen roller 60.

Notably, the locating shaft 70 has two radially extending projections 73 on end 71*b* that can be used to locate and align the print head 52 with the guides, platen roller 60, and other components of the lower print frame 38. As the print head 52 is located some distance from the hinge 40 connecting the upper print frame 36 and the lower print frame 38, there is a risk that, without guidance, the print head 52 may deviate from a target position for best printing when the print assembly 34 is in the closed position. The two radially extending projections 73 may slide into a groove in one of the pair of locating slots 47 in the lower print frame 38 to prevent the lateral or side-to-side movement of the print head 52 relative to the lower print frame 38. However, the two radially extending projections 73 and groove still allow for some axial rotation of the print head 52 about the locating shaft 70, such that the print face 62 of the print head 52 can be urged against the platen roller 60, as will be described in detail below.

Figure 7:
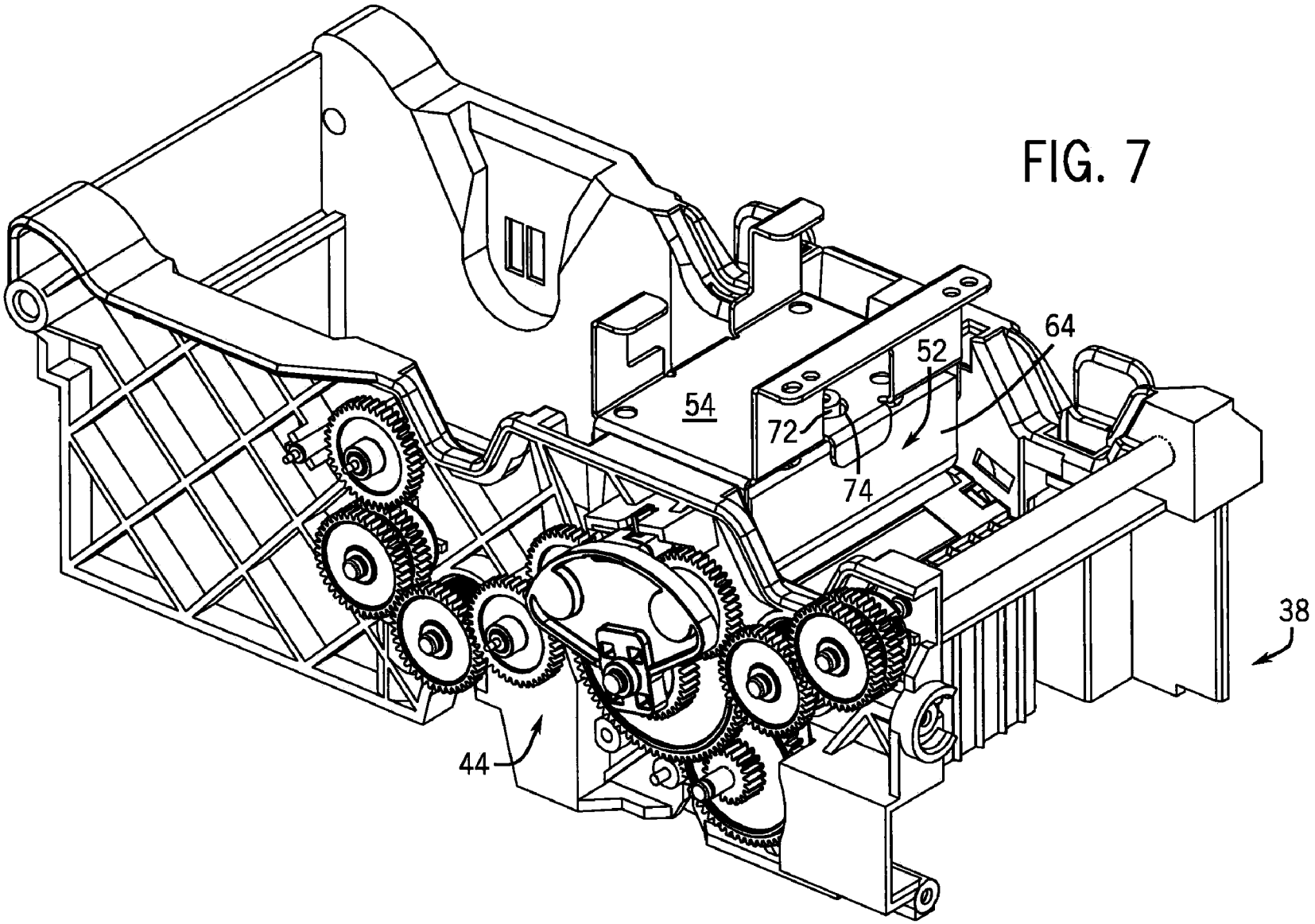
FIG. 7 is a front side perspective view of the print assembly with the upper frame hidden, but with the bracket and the print head in place.
Figure 8:
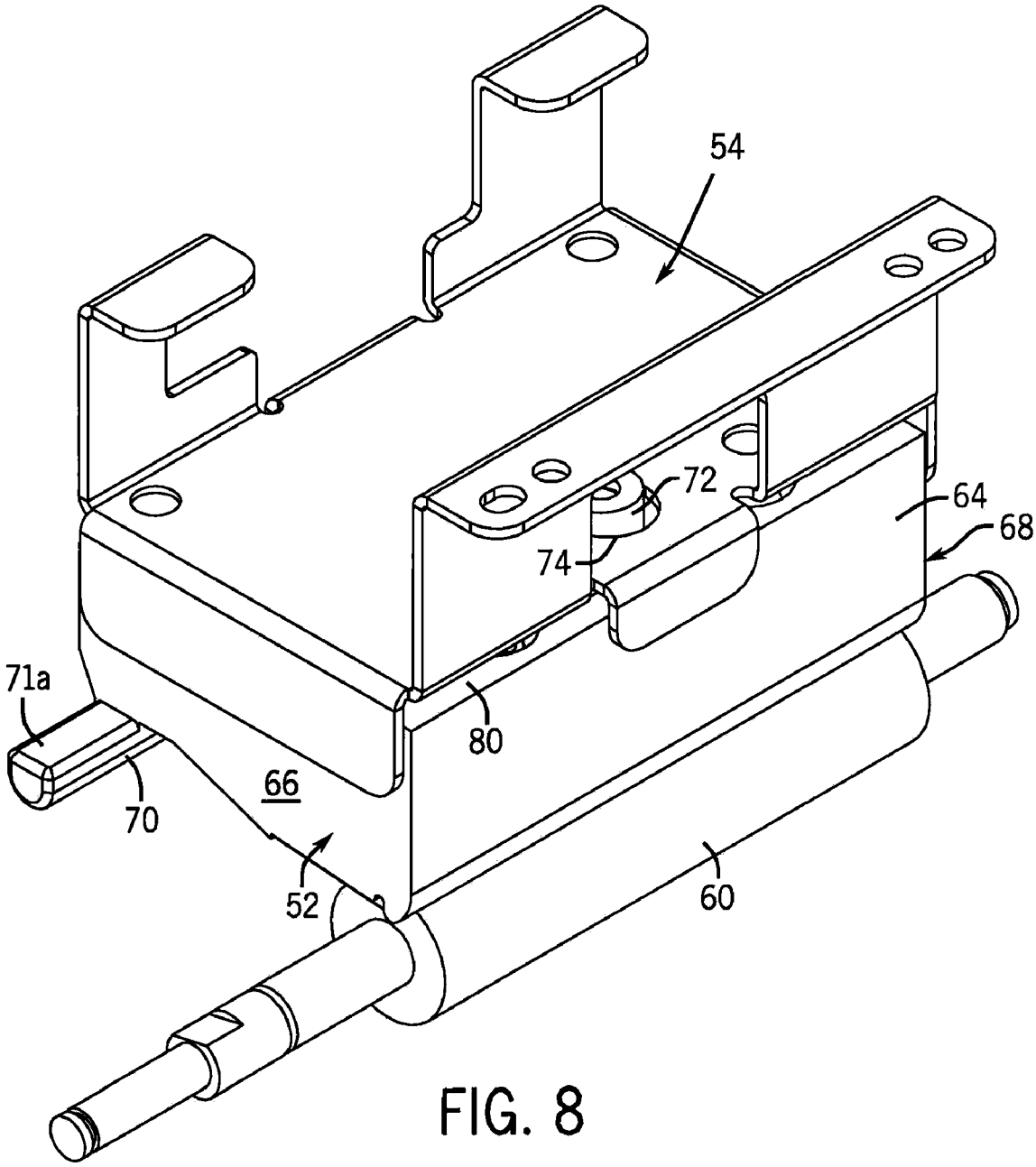
FIG. 8 is a front side perspective view of the sub-assembly of the bracket and the print head with the platen roller.
Figure 9:
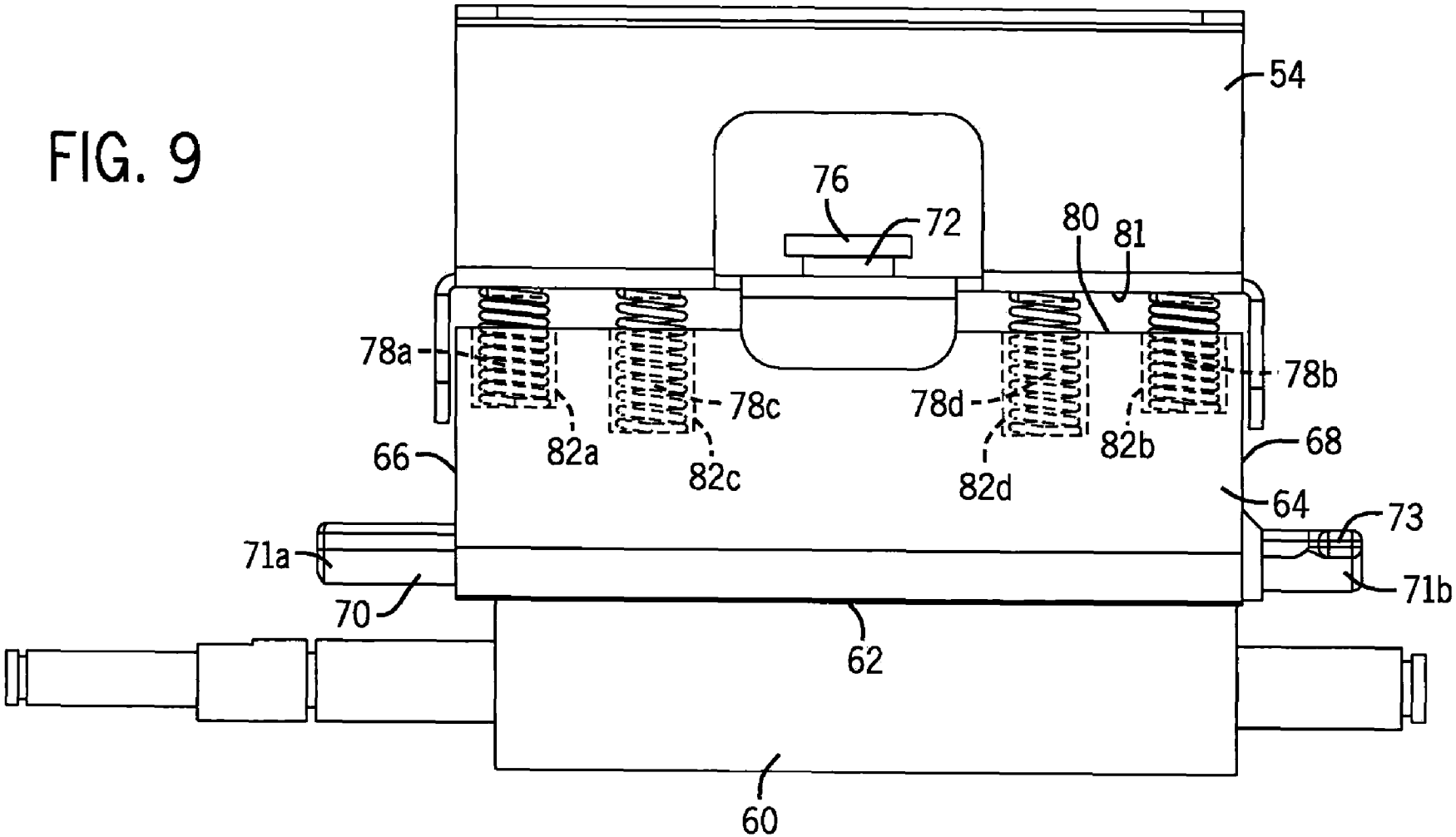
FIG. 9 is a front plan view of the sub-assembly of FIG. 8.

Referring now to FIG. 7-9 (with various portions of the print assembly 34 removed for clarity), the bracket 54 and the print head 52 can be seen with the print head 52 biased away from the bracket such that the print face 62 is pressed against the platen roller 60. The bracket 54 is rigidly connected to the upper print frame 36. The bracket 54 and the print head 52 are moveably coupled with a biasing mechanism therebetween.

The print head 52 may be moveably coupled to the bracket 54 in a number of ways. In one form, the bracket 54 is moveably coupled to the print head 52 via a tab 75 (as best seen in FIG. 4) that extends horizontally from the back of the bracket 54 towards the front of the bracket 54 to prevent the print head 52 from rotating away from the bracket 54. In another form, the bracket 54 is moveably connected to the print head 52 via a post 72 extending from the print head 52 through a hole 74 on the bracket 54. A retaining cap 76 may be secured to the post 72, the retaining cap 76 having an outer diameter greater than the diameter of the hole 74, such that the print head 52 and the bracket 54 cannot be separated. It should be appreciated that variants of these movable couplings could also be used (e.g., the post 72 could extend from the bracket 54 into a hole in the print head 52).

A plurality of biasing members 78*a*, 78*b*, 78*c*, 78*d*, shown as springs, bias the print head 52 away from the bracket 54. The plurality of biasing member 78*a*, 78*b*, 78*c*, 78*d* are located between a lower face 81 of the bracket 54 and an upper face 80 of the print head 52. The heat sink 64 of the print head 52 has a plurality of holes 82*a*, 82*b*, 82*c*, and 82*d* for receiving one end of each of the corresponding plurality of biasing members 78*a*, 78*b*, 78*c*, 78*d*. The other end of each of the corresponding plurality of biasing members 78*a*, 78*b*, 78*c*, 78*d* are pressed against the lower face 81 of the bracket 54. The distance between the bottom of the holes 82*a*, 82*b*, 82*c*, 82*d* and the lower face 81 of the bracket 54 is less than the uncompressed length of each of the plurality of biasing members 78*a*, 78*b*, 78*c*, 78*d*. As such, when the plurality of biasing members 78*a*, 78*b*, 78*c*, 78*d* are captured between the print head 52 and the bracket 54, they are forced into compression so as to bias the print head 52 away from the bracket 54.

Figure 10:
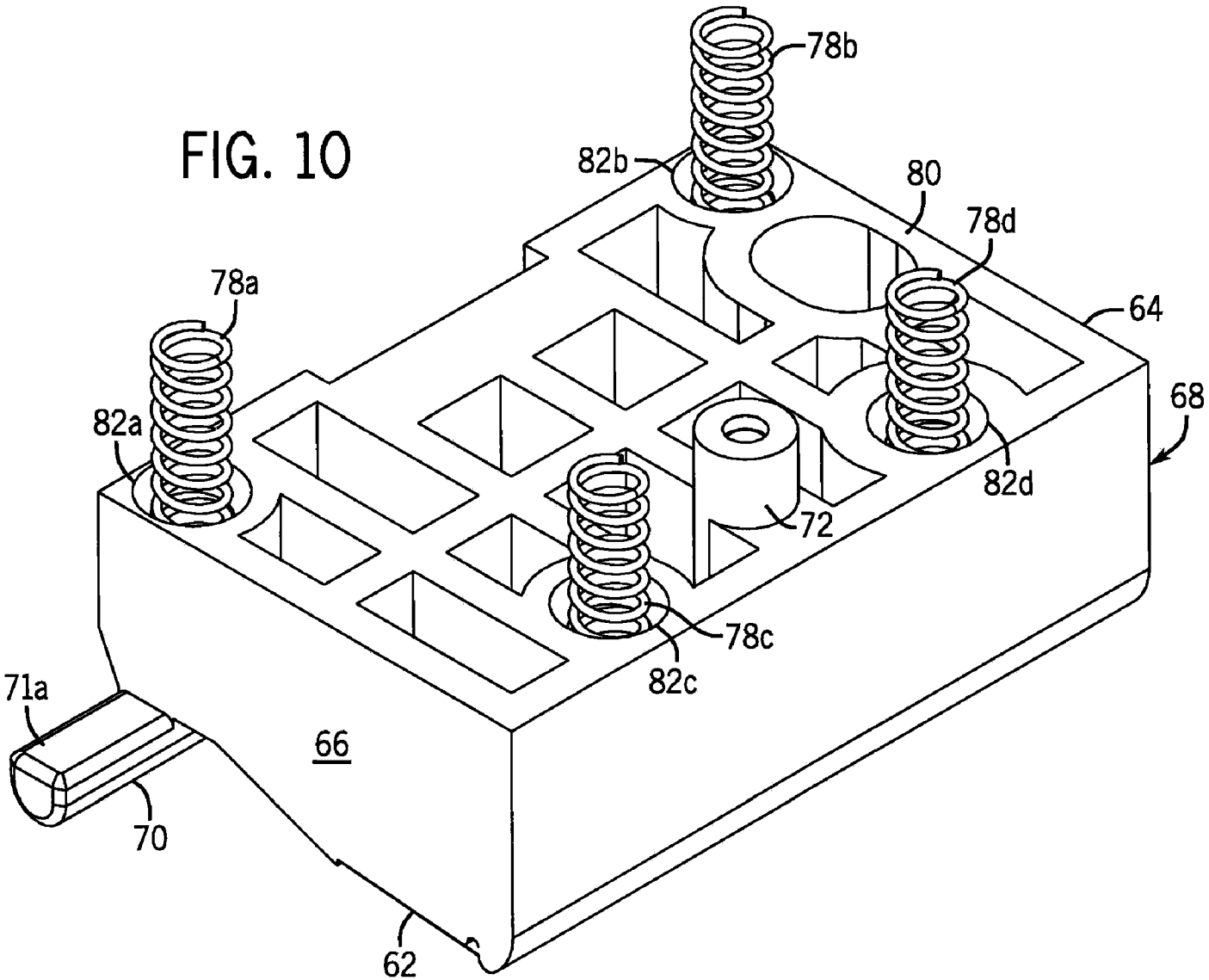
FIG. 10 is a front side perspective view of the print head with the bracket removed.
Figure 11:
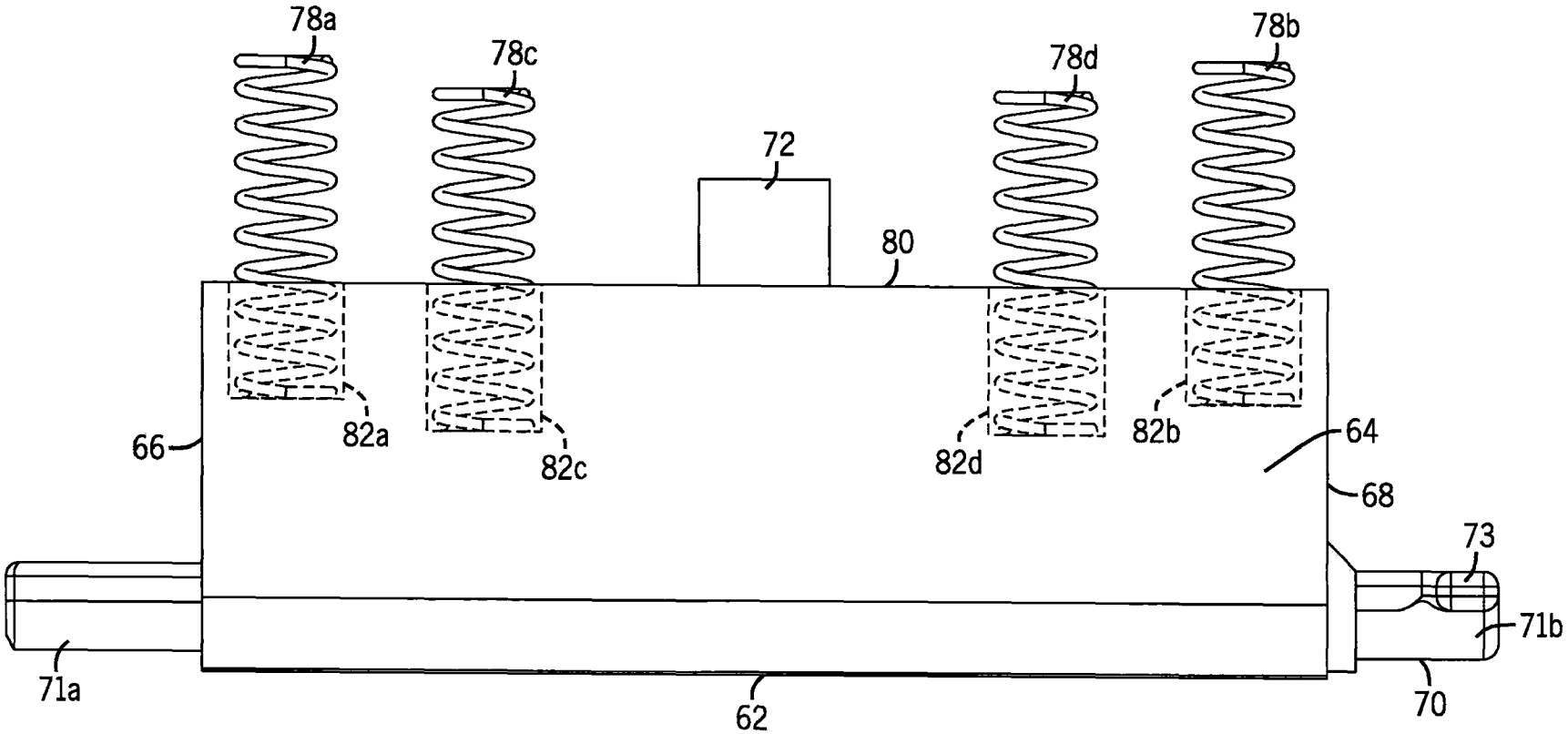
FIG. 11 is front plan view of FIG. 10.

As can be seen in FIGS. 10 and 11, in which the bracket 54 has been separated from the print head 52, the plurality of biasing members 78*a*, 78*b*, 78*c*, 78*d* are equal lengths. However, notably, the depth of the holes 82*a*, 82*b* closest to the lateral ends 66, 68 and proximate the locating shaft 70 are shallower than the holes 82*c*, 82*d* that are proximate the print face 62. Given that the lower face 81 of the bracket 54 is substantially planar and the lengths of the uncompressed springs are equal, when the bracket 54 and the print head 52 are moveably coupled together, the two of the plurality of biasing members 78*a*, 78*b* that are proximate the locating shaft 70 are in greater compression than the two of the plurality of biasing members 78*c*, 78*d* proximate the print face 62. Thus, the two of the plurality of biasing members 78*a*, 78*b* proximate the locating shaft 70 exert a greater biasing force against the print head 52, than the two of the plurality of biasing members 78*c*, 78*d* proximate the print face 62.

It should be appreciated that non-similar springs (i.e., springs having different spring constants) or other types biasing members can be used to achieve the same biasing effect. However, to retain the locating shaft 70 in the locating slots 47, it will be preferable that the biasing members proximate the locating shaft 70 exert a greater biasing force than the biasing members proximate the print face 62. Alternatively, a single biasing member, properly positioned between the bracket 54 and the print head 52 may have the same effect in which different forces are applied the shaft and print face ends of the print head 52.

When the upper print frame 36 and the lower print frame 38 are moved to the closed position in which the locating shaft 70 is received in the locating slots 47 (as shown in FIG. 12), the stronger biasing force of two of the plurality of biasing members 78*a*, 78*b* exert a force on the locating shaft 70 urging the locating shaft 70 in the locating slots 47. This force is greater than the weaker biasing force of the other two of the plurality of biasing members 78*c*, 78*d* urging the print face 62 towards the platen roller 60.

Thus, the stronger biasing force retains the locating shaft 70 in the locating slot 47 and defines a pivot axis for the print head 52. The weaker biasing force applies a uniform pressure over a width of the print face 62. In order to achieve this functionality, it may be necessary that the biasing members exert forces of a certain magnitude and/or have a differential of a particular magnitude between the biasing members proximal the locating shaft 70 and the biasing members proximal the print face 62.

As the locating shaft 70 is restricted to pivotal motion about an axis by the two of the biasing members 78*a*, 78*b* proximal the locating shaft, the pressure applied across the print face 62 by the other two biasing members 78*c*, 78*d* is evenly applied as the print head 52. Thus, the print media can be fed between the print head 52 and the platen roller 60 in an edge-justified manner without skewing the print or having areas that are printed lighter than other areas as a result of uneven pressure being applied across the print head.

Of course, if the biasing force holding the locating shaft 70 in the locating slots 47 is insufficient to retain the locating shaft 70 in the locating slots 47, then the print head 52 may skew. Thus, it is important that the biasing force against the locating shaft 70 exceeds the biasing force against the print face 62 by a magnitude sufficient to retain the locating shaft 70 in the locating slots 47 during a printing operation. To this end, it may also be preferable to have the rear biasing members closer to the lateral ends of the print head than the front biasing members. This configuration promotes the retention of the ends 71*a*, 71*b* of the locating shaft 70 in the locating slots 47. Further, the plurality of biasing members 78*a*, 78*b*, 78*c*, and 78*d* may be symmetrical about a plane running though the print head 52 in the direction of the print media is fed through the printer 10. However, it is contemplated that configurations in which the biasing members are non-symmetric could also be used.

Although an embodiment has been described having four biasing members, other quantities of biasing members can be used. It is contemplated that the described functionality could be achieved by a structure having as few as one biasing member. Any number of biasing members may be used, so long as they can (1) define the pivot axis of the print head such that (2) an even pressure is applied across the print face. In one embodiment, the assembly could include two biasing members: a first biasing member that is located proximal the locating shaft end of the print head and a second biasing member that is located proximal the print face.

Additionally, it should be appreciated that configurations other than a locating shaft 70 being received in a pair of locating slots 47 may be suitable to achieve the pivot axis of the print head 52. For example, the locating shaft 70 could be received in a single locating groove in the lower print frame 38.

Although the frame has been shown to include an upper and lower print frame, it is contemplated that similar functionality could be achieved having single frame. For example, the print head 52 could be biased against a portion of a frame while another portion of the frame is used to locate and define the pivot axis of the print head 52.

One benefit of having a two-piece frame assembly, however, is that the it is easy to place the print media on the roll assembly 46 between the print head 52 and the platen roller 60 when the print assembly 34 is in the opened position.

Many modifications and variations to this preferred embodiment will be apparent to those skilled in the art, which will be within the spirit and scope of the invention. Therefore, the invention should not be limited to the described embodiment. To ascertain the full scope of the invention, the following claims should be referenced.

INDUSTRIAL APPLICABILITY

The invention provides a print head assembly for a printer providing uniform pressure over a print face for improved printing and, in particular, improved edge-justified printing.

What is claimed is:

1. A print head assembly for a printer providing uniform pressure over a print face, the print head assembly comprising:

a frame having a pair of opposite-facing side walls;

a platen roller rotatably mounted between the side walls of the frame about an axis of rotation;

a print head having a print face extending between ends of the print head, the print head being pivotally movable relative to the frame about a pivot axis parallel to the axis of rotation of the platen roller; and at least one biasing member located between the frame and the print head, the at least one biasing member urging the print head towards the pivot axis with a first force and also urging the print face towards the platen roller with a second force, the first force being greater than the second force such that the first force maintains the pivot axis of the print head and the second force applies a uniform pressure over a width of the print face.

2. The print head assembly of claim 1, wherein the frame comprises an upper print frame and a lower print frame, the upper print frame including a bracket that is rigidly connected to the upper print frame and that is movably coupled to the print head.

3. The print head assembly of claim 2, wherein the bracket is moveably coupled to the print head via a tab that extends horizontally from the front of the bracket towards the back of the bracket to prevent the print head from rotating away from the bracket.

4. The print head assembly of claim 2, wherein the bracket is moveably coupled to the print head via a post on one of the print head and the bracket extending through a hole on the other of the print head and the bracket, the post having a retaining cap that prevents the print head and the bracket from separating.

5. The print head assembly of claim 2, further comprising a pivot that rotatably connects the upper print frame to the lower print frame and further comprising a latch opposite the pivot to retain the upper print frame and the lower print frame in a closed position, thereby keeping the print face against the platen roller and retaining a locating pivot shaft of the print head in the locating slot of the lower print frame.

6. The print head assembly of claim 5, wherein the pivot is a hinge.

7. The print head assembly of claim 1, wherein the print head is a thermal print head and at least a portion of the print head is a heat sink.

8. The print head assembly of claim 7, wherein the thermal print head prints labels.

9. The print head assembly of claim 1, wherein the at least one biasing member includes:

at least one biasing member proximal each end of the print head to urge the print head towards the pivot axis with the first force; and at least one biasing member proximal the print face to urge the print face towards the platen roller with the second force.

10. The print head assembly of claim 9, wherein the at least one biasing member proximate the pair of ends of the print head are configured to provide a greater biasing force than the at least one biasing member proximate the print face such that the pivot axis of the print head is maintained and the print head does not skew during an edge-justified printing operation.

11. The print head assembly of claim 1, wherein the at least one biasing member is a spring.

12. The print head assembly of claim 1, wherein the at least one biasing member is a plurality of biasing members that are symmetrical about a plane extending though the print head in the direction of printing.

13. A print head assembly for a printer providing uniform pressure over a print face, the print head assembly comprising:

an upper print frame and a lower print frame, the lower print frame having a pair of opposite-facing side walls with a platen roller extending therebetween and a pair of locating slots formed therein;

a print head movably coupled to the upper print frame, the print head having an upper face facing the upper print frame, a locating pivot shaft proximate one end of the print head, and a print face proximate an other end of the print head;

a plurality of biasing members located between the upper print frame and the upper face of the print head including at least a first biasing member proximate the locating pivot shaft and at least a second biasing member proximate the print face, each of the at least one first biasing member being further from a centerline of the print head along a direction of printing than the at least one second biasing member proximate the printing face;

wherein, when the upper print frame and the lower print frame are coupled together, the at least one first biasing member proximate the locating pivot shaft urges the locating pivot shaft into the pair of locating slots such that the print head assembly can pivot about the locating pivot shaft while the at least one second biasing member proximate the print face provides uniform pressure across the print face over the length of the platen roller without skewing of the print head.

14. The print head assembly of claim 13, wherein the at least one first biasing member includes two biasing members.

15. The print head assembly of claim 13, wherein the at least one second biasing member includes two biasing members.

* * * * *